US011118813B2

(12) United States Patent
Carpenter

(10) Patent No.: US 11,118,813 B2
(45) Date of Patent: Sep. 14, 2021

(54) TANKLESS WATER HEATER AND MANIFOLD SYSTEM

(71) Applicant: Scott Carpenter, Mobile, AL (US)

(72) Inventor: Scott Carpenter, Mobile, AL (US)

( * ) Notice: Subject to any disclaimer, the term of this patent is extended or adjusted under 35 U.S.C. 154(b) by 2 days.

(21) Appl. No.: 16/568,523

(22) Filed: Sep. 12, 2019

(65) Prior Publication Data

US 2021/0080148 A1 Mar. 18, 2021

(51) Int. Cl.

| | |
|---|---|
| ***F24H 9/20*** | (2006.01) |
| ***F24H 9/18*** | (2006.01) |
| ***F24H 1/14*** | (2006.01) |
| ***F24H 9/12*** | (2006.01) |
| ***F24D 19/10*** | (2006.01) |
| ***F24D 17/00*** | (2006.01) |
| ***F24H 1/10*** | (2006.01) |
| ***F24H 9/02*** | (2006.01) |

(52) U.S. Cl.

CPC ..... *F24H 9/128* (2013.01); *F24D 17/0026* (2013.01); *F24D 19/1051* (2013.01); *F24H 1/10* (2013.01); *F24H 9/02* (2013.01); *F24D 2220/0228* (2013.01); *F24H 1/145* (2013.01); *F24H 9/1836* (2013.01); *F24H 9/2035* (2013.01); *Y10T 137/87877* (2015.04)

(58) Field of Classification Search

CPC ..... F22B 27/00; F22B 35/005; F24H 9/128; F24H 1/10; F24H 1/102; F24H 9/2035; F24H 9/1836; F24H 1/145; F24D 17/0026; F24D 19/1051; F24D 2220/0228; Y10T 137/87877

See application file for complete search history.

(56) References Cited

U.S. PATENT DOCUMENTS

| | | | | |
|---|---|---|---|---|
| 5,408,578 A * | 4/1995 | Bolivar | F24H 1/102 219/481 |
| 6,058,975 A * | 5/2000 | Hui-Chen | F16K 11/20 137/271 |
| 2004/0197093 A1* | 10/2004 | Dufour | F24H 1/102 392/447 |
| 2005/0185942 A1* | 8/2005 | Fabrizio | F24H 1/103 392/485 |
| 2015/0114490 A1* | 4/2015 | Carpenter | E03B 7/071 137/460 |

OTHER PUBLICATIONS

Klein, G. (Mar./Apr. 2005). Hot-Water Distribution Systems—Part II. IAPMO Official, 27(2), 20-24. ISSN 0192-5784 (Year: 2005).*

Standard-Wall Steel Pipe Nipple. (2011). McMaster-Carr. https://www.mcmaster.com/44615K412/(Year: 2011).*

Dark Gray PVC On/Off Valve. (2015). McMaster-Carr. https://www.mcmaster.com/45975K27/ (Year: 2015).*

* cited by examiner

*Primary Examiner* — Edelmira Bosques
*Assistant Examiner* — Benjamin Trettel
(74) *Attorney, Agent, or Firm* — George L Williamson

(57) ABSTRACT

A tankless water heater and manifold system is provided. The system includes a self-contained unit for providing hot water distribution throughout the system. The unit includes a tankless water heater having a hot water outlet pipe with outlet ports that function as a built-in manifold for distributing water directly from the unit through hot water lines that connect each plumbing fixture in the system directly to the unit.

12 Claims, 5 Drawing Sheets

TANKLESS WATER HEATER AND MANIFOLD SYSTEM

FIELD OF THE INVENTION

The subject matter of the present disclosure generally relates to a tankless water heater system having a built-in manifold for distributing hot water to multiple plumbing fixtures.

BACKGROUND

Tankless water heaters are a type of water heater that heats water continuously as the water flows through a heat exchanger coil inside the water heater. These types of water heaters do not have a holding tank and thus do not retain any water internally except for the water contained within the exchanger coil. Tankless water heaters are commonly described as "instant" hot water heaters or "on-demand" hot water heaters. However, such descriptors are misleading, as tankless water heaters do not supply hot water instantaneously and typically take the same amount of time as older model heaters having tanks to supply hot water to a plumbing fixture once the fixture is opened. Although tankless heaters may supply hot water continuously as long as a fixture is open, unlike water heaters with tanks that only supply a finite volume of hot water, it still takes time for the hot water to reach the fixture from the heating source.

In a typical water heating system in a residential or commercial building, a tankless heater may be installed having a hot water outlet pipe through which hot water exits the heater continuously as the water is heated. The hot water outlet feeds a header that has hot water distribution lines branching off of the header to individual plumbing fixtures. The header typically has a larger diameter than each of the individual hot water lines distributing water to plumbing fixtures in order to adequately supply hot water when multiple fixtures are used simultaneously. To provide an adequate volume of hot water to the system of distribution lines, the header line may sometimes have a diameter that is twice the size of the diameter of individual distribution lines. Because hot water fixtures are used only intermittently, the water between the heater and each fixture, including the water in the header as well as distribution lines, often cools between uses. Thus, when a hot water fixture is opened, the water in the distribution line feeding the fixture, as well as the water in the header filling the volume between the water heater and the connection to the specific distribution line, must be displaced with heated water exiting the heater before hot water is delivered to the fixture. This process takes time and also results in a volume of unheated water flowing through the plumbing fixture before hot water begins to flow from the fixture. The amount of time before hot water flows depends on the proximity of the fixture to the water heater and the size of the header and distribution line, but in residential and commercial buildings it often takes 20 second or longer before hot water flows from a fixture, thereby resulting in an inconvenient delay and wasted water.

Accordingly, a need exists in the art for an improved water heater system and method for supplying hot water to plumbing fixtures that supplies hot water faster and with less wasted water than conventional systems.

SUMMARY

A tankless water heater system, apparatus, and method for supplying hot water to a plurality of plumbing fixtures are provided. The system comprises a tankless water heater having a hot water outlet pipe having a plurality of outlet ports arranged along a length of the hot water outlet pipe. The tankless water heater and the hot water outlet pipe form a self-contained unit that may be mounted onto a fixed structure in a location suitable for connecting a cold water supply line to the unit in order to supply hot water from the unit to a plurality of plumbing fixtures in a residential or commercial building. The self-contained unit preferably has a case that houses both the tankless water heater and the hot water outlet pipe. The system further comprises a plurality of hot water lines. Each hot water line connects one outlet port on the hot water outlet pipe to one plumbing fixture so that hot water is supplied to the fixture through the hot water line. Thus, each fixture in the system has its own designated hot water line individually connecting the fixture directly to the self-contained unit. The system does not utilize a header that is separate and remote from the self-contained unit for connecting water distribution lines to supply hot water to multiple fixtures. Thus, the arrangement of the present system minimizes to the maximum extent possible the amount of water that must be displaced to supply hot water to each plumbing fixture, thereby reducing both the wait time for hot water to flow from a fixture once opened and the volume of unheated water wasted that flows through the fixture during the wait time.

In a preferred embodiment, the self-contained unit including the tankless heater and hot water outlet pipe further comprises a valve connected to each outlet port on the hot water outlet pipe. Individual hot water lines may then be connected to each outlet port by connecting each hot water line to a valve. The valves allow each hot water line to be isolated individually for maintenance on any plumbing fixture or water line without the necessity of shutting off the water supply to the entire system.

The foregoing summary has outlined some features of the system and methods of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purposes of the system and methods disclosed herein. Those skilled in the pertinent art should also realize that such equivalent designs or modifications do not depart from the scope of the system and methods of the present disclosure.

DESCRIPTION OF THE DRAWINGS

These and other features, aspects, and advantages of the present disclosure will become better understood with regard to the following description, appended claims, and accompanying drawings where:

DETAILED DESCRIPTION

In the Summary above and in this Detailed Description, and the Claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components, or can contain at least one component chosen from A, B, or C. As used herein, the term "removably connect" means that components may be connected to and disconnected from each other using tools without causing damage to the components being connected or disconnected.

Where reference is made herein to a method comprising two ore more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
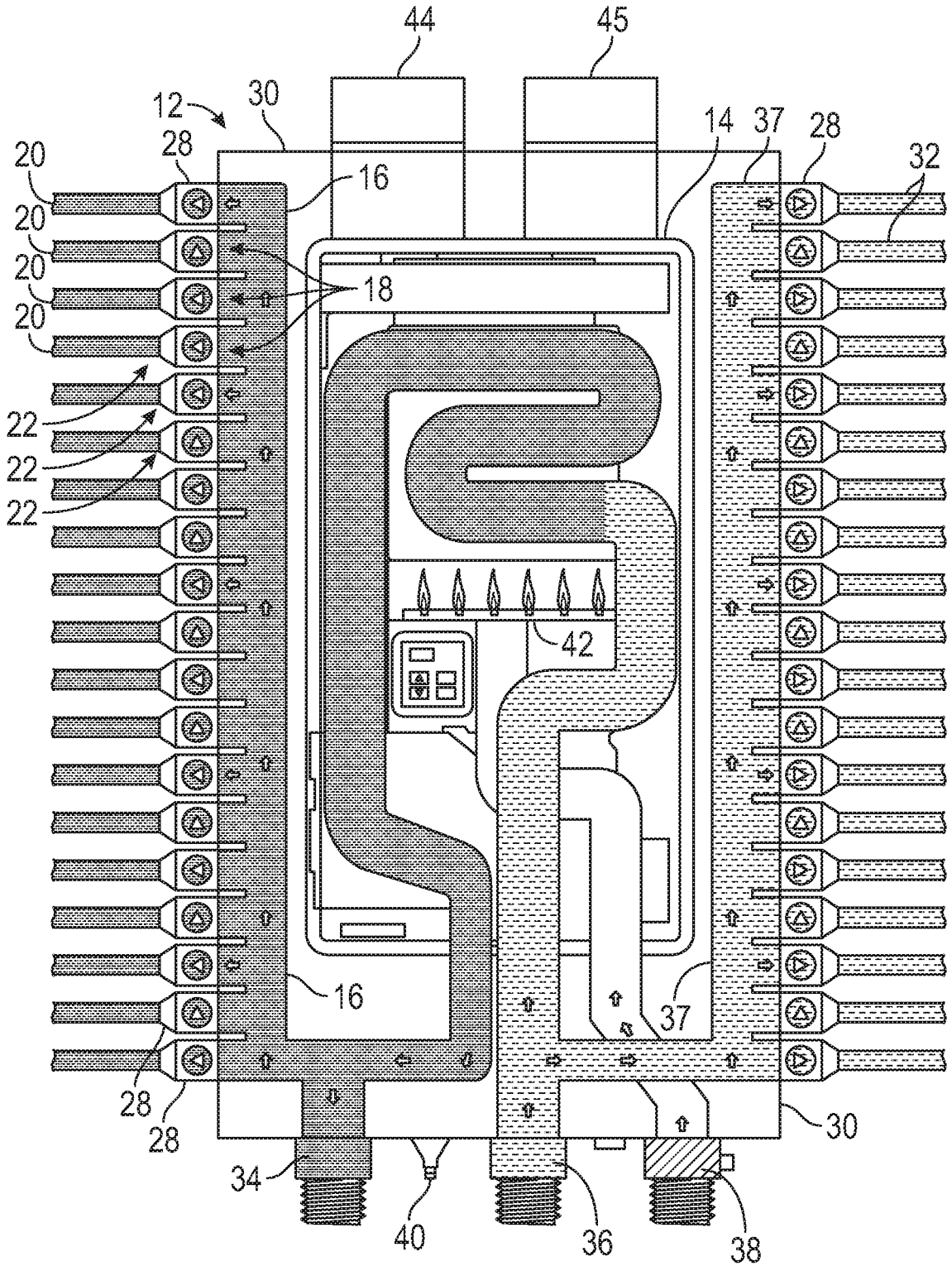
FIG. 1 shows a partial interior cross-sectional view of a tankless water heater system in accordance with the present disclosure.

Turning now to the drawings, FIGS. 1-4 illustrate preferred embodiments of a tankless water heater system 10 for supplying hot water to a plurality of plumbing fixtures 26. The system 10 comprises a tankless water heater 14 having a hot water outlet pipe 16. The hot water outlet pipe 16 has a plurality of outlet ports 18 arranged along a length of the hot water outlet pipe 16, as best seen in FIG. 1. The outlet ports 18 are used to supply hot water from the hot water outlet pipe 16 into individual hot water lines 20 connected to each outlet port 18 for supplying hot water to a plumbing fixture 26. The plurality of outlet ports 18 may be formed by a series of "T" junctions along the length of the hot water outlet pipe 16, as shown in FIG. 1. Each outlet port 18 is adapted to connect a water line 20 directly to the outlet port 18 or via a valve 28 connected to the outlet port 18. Thus, each outlet port 18 comprises structure suitable for connecting piping components to the port 18.

The tankless water heater 14 and the hot water outlet pipe 16 in combination, including the outlet ports 18, form a self-contained unit 12. Thus, the hot water outlet pipe 16 and outlet ports 18 function as a built-in manifold for the tankless water heater 14 system. The built-in manifold provides water distribution to all fixtures 26 directly from the unit 12. This heater and manifold arrangement minimizes the amount of water that must be displaced to supply hot water to an individual plumbing fixture 26, thereby speeding up hot water delivery to fixtures and reducing wasted water.

Figure 2:
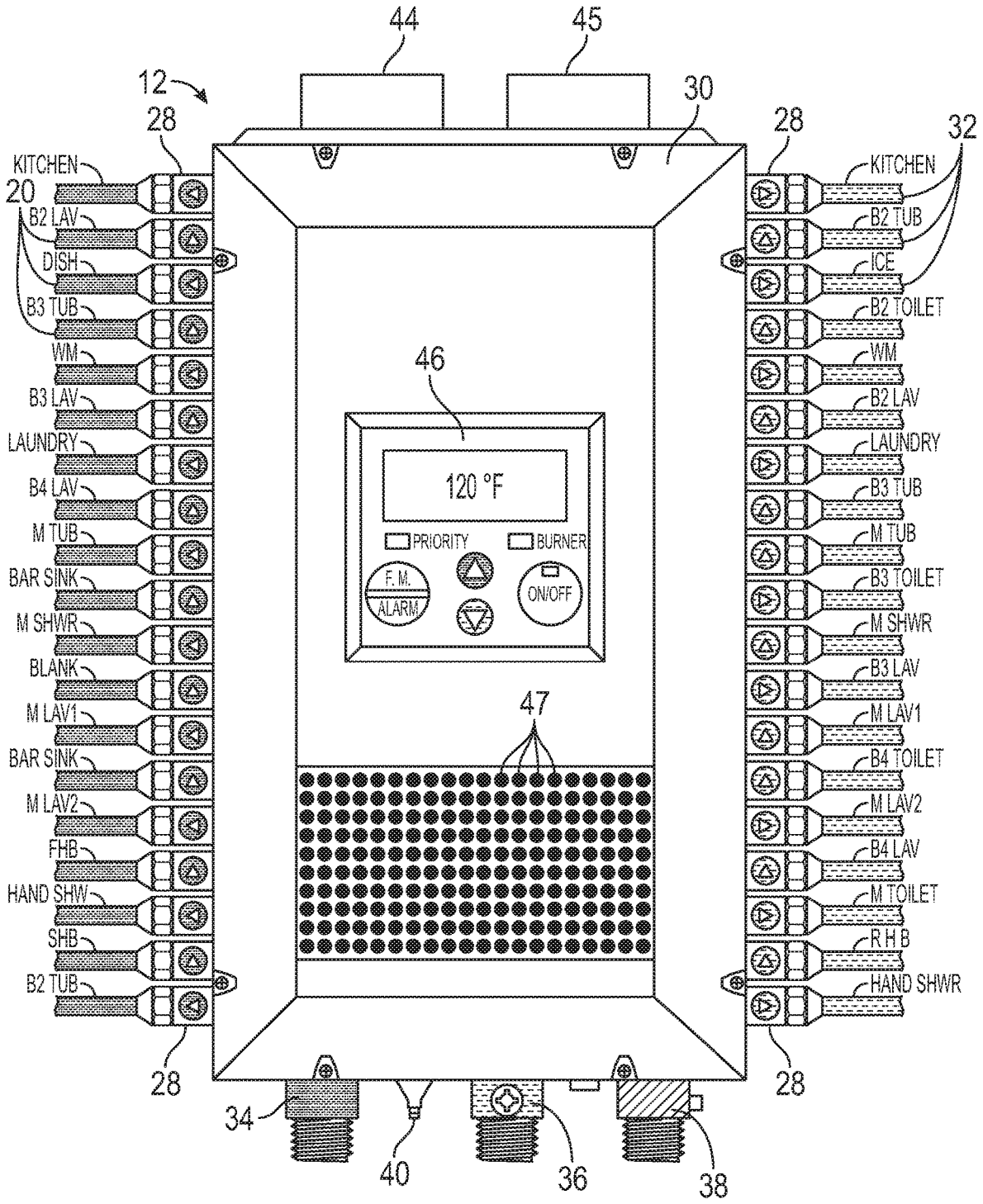
FIG. 2 shows a front elevational view of a tankless water heater system in accordance with the present disclosure.

The self-contained unit 12 may be mounted onto a fixed structure in a location suitable for connecting a cold water supply line to the unit 12 in order to supply hot water from the unit to a plurality of plumbing fixtures 26 in a residential or commercial building. As best seen in FIG. 2, the self-contained unit 12 preferably has a case 30 that houses both the tankless water heater 14 and the hot water outlet pipe 16. Each hot water line 20 may be connected to a respective outlet port 18 through a plurality of respective openings 31 in the case 30, with each opening 31 corresponding to one outlet port 18. Alternatively, the unit 12 may not have a case, or the case may house only the tankless heater 14 and not the hot water outlet pipe 16, which may be disposed on an exterior of the case. However, the unit 12 is self-contained in that the unit may be installed or mounted using brackets 48 or other types of supports that support the combination of both the tankless heater 14 and the hot water outlet pipe 16 as a single unit 12. The unit 12 has a compact size due to the hot water outlet pipe 16 not being located remote to or separate from the tankless heater 14. Thus, the unit 12 does not require a separate header pipe for water distribution to the system 10. The compact size of the unit 12 also allows the unit to be easily shipped or otherwise transported as a unit to an installation location or to be manually lifted or carried as a unit during installation.

As shown in FIG. 1, the heat source of the tankless water heater 14 is preferably natural gas, though an electric heater or other type of tankless heater may alternatively be used. The heater 14 has a gas inlet 38 to supply natural gas to a burner 42 for heating water supplied through a cold water inlet 36, which may be supplied from a connection to a municipal water supply. In a preferred embodiment, the hot water outlet pipe 16 is a vertically arranged pipe that is fed with heated water that flows out of a bottom side of the tankless water heater 14 and into the hot water outlet pipe 16 at a bottom end of the pipe, as shown in FIG. 1. The unit 12 may optionally include a cold water supply pipe 37 for supply cold water to plumbing fixtures 26 through cold water lines 32 from the cold water inlet 36 to the unit 12. This arrangement allows for distribution of both hot and cold water from a single municipal water supply source through a single heater unit 12. Thus, the unit 12 may be utilized as a complete water distribution and heating system for a building. The cold water supply pipe 37 is preferably also vertically arranged and may be disposed on an opposite side of the tankless heater 14, as shown in FIG. 1. This configuration of both the hot water outlet pipe 16 and the cold water supply pipe 37 provides a self-contained unit 12 that is compact in size for ease of transportation and installation and that minimizes the volume of water contained within the heater and manifold. Both the hot water outlet pipe 16 and the cold water supply pipe 37 are preferably housed inside the case 30.

As shown in FIG. 2, the unit 12 preferably has a control panel 46 on the exterior of the case 30 for controlling the unit. For instance, the control panel 46 may be used to adjust the temperature of the hot water exiting the unit 12. The control panel 46 may also provide alerts or indicator lights, which may indicate whether the burner 42 is operating or other functions of the unit. The case 30 preferably has a plurality of air inlet holes 47 or vents to provide interior ventilation. Also, the unit 12 preferably has a fresh air intake 44 and an exhaust outlet 45 for the gas burner 42. In addition, the unit 12 preferably has a lower outlet fitting 34 for draining water from the unit 12 to relieve pressure for maintenance or to connect a temporary line for descaling. This fitting 34 is capped during normal operation of the unit 12. The unit 12 may also have a condensation drain 40 for draining condensation that may form in the interior of the case 30.

Figure 4:
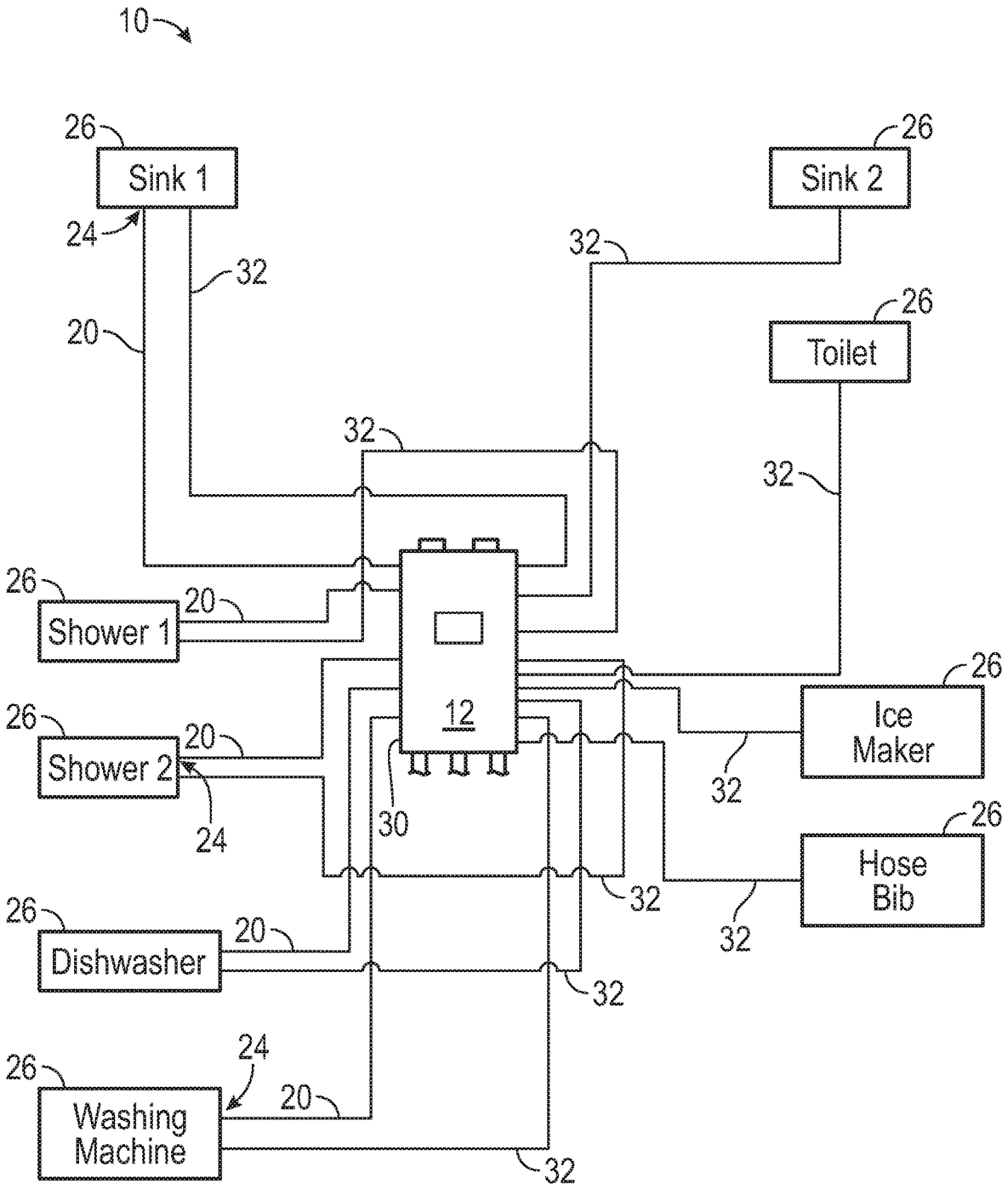
FIG. 4 shows a schematic view of a tankless water heater system in accordance with the present disclosure.

The system 10 further comprises a plurality of hot water lines 20 each individually connected at one end 22 to a respective one of the plurality of outlet ports 18 on the hot water outlet pipe 16, as shown in FIG. 1. Each hot water line 20 is connected at an opposing end 24 to a plumbing fixture 26, as shown in FIG. 4. Each hot water line 20 is in fluid communication with the hot water outlet pipe 16 when connected to an outlet port 18 to provide hot water to the fixtures 26. Thus, each individual hot water line 20 directly connects one outlet port 18 to one plumbing fixture 26 without connecting to a common header external to the unit 12.

FIG. 4 illustrates a schematic diagram of a typical water heater system 10 that may be installed in a residential home. The system 10 comprises a self-contained unit 12 and a plurality of plumbing fixtures 26 of various types. The system 10 includes several different types of fixtures, but may be adapted to include more fixtures or fewer fixtures, as needed. The unit 12 houses the tankless water heater 14 and the hot water outlet pipe 16, as well as the optional cold water supply pipe 37, for distributing both hot and cold water to the fixtures 26. In this case, hot water lines 20 are connected to the left side of the unit 12, and cold water lines 32 are connected to the right side of the unit 12, as is also shown in FIGS. 1 and 2. As seen in FIG. 4, some fixtures 26 require both hot and cold water, while others require cold water only. For fixtures requiring both hot and cold water, separate hot water lines 20 and cold water lines 32 run directly from the unit 12 to each fixture 26. Fixtures such as the toilet fixture, ice maker fixture, and hose bib fixture have only a cold water line 32. Thus, the unit 12 may have a different number of hot water lines 20 and cold water lines 32 to distribute water as needed. Although FIGS. 1 and 2 illustrate water distribution lines connected to every outlet port 18, the unit 12 may be customized for each application by using only as many outlet ports 18 as needed. Some units 12 may have more outlet ports 18 than others to accommodate buildings having a greater number of plumbing fixtures 26.

In a preferred embodiment, as best seen in FIG. 1, each hot water line 20 has a diameter smaller than a diameter of the hot water outlet pipe 16. In one preferred embodiment, the hot water outlet pipe 16 may have a ¾ inch diameter, and the hot water lines 20 may each have a diameter of ½ inch or ⅜ inch depending on the fixture 26. For example, a bath tub or shower fixture may have a ½ inch diameter hot water line 20, while a small vanity sink may have a ⅜ inch hot water line 20. The hot water line 20 diameter may vary depending on the required water flow for a specific fixture, though in any case both lines 20 have a smaller diameter than the hot water outlet pipe 16. In a preferred embodiment, some of the plurality of hot water lines 20 may have a different diameter than other hot water lines 20 to accommodate various types of plumbing fixtures 26. The hot water outlet pipe 16 has a larger diameter than the hot water distribution lines 20 so that the hot water outlet pipe 16 may adequately supply hot water to multiple fixtures 26 simultaneously. However, because the smaller diameter distribution lines 20 connect directly from the unit 12 to the fixtures 26, the volume of water required to be displaced to deliver hot water to each fixture 26 is minimized.

Figure 3:
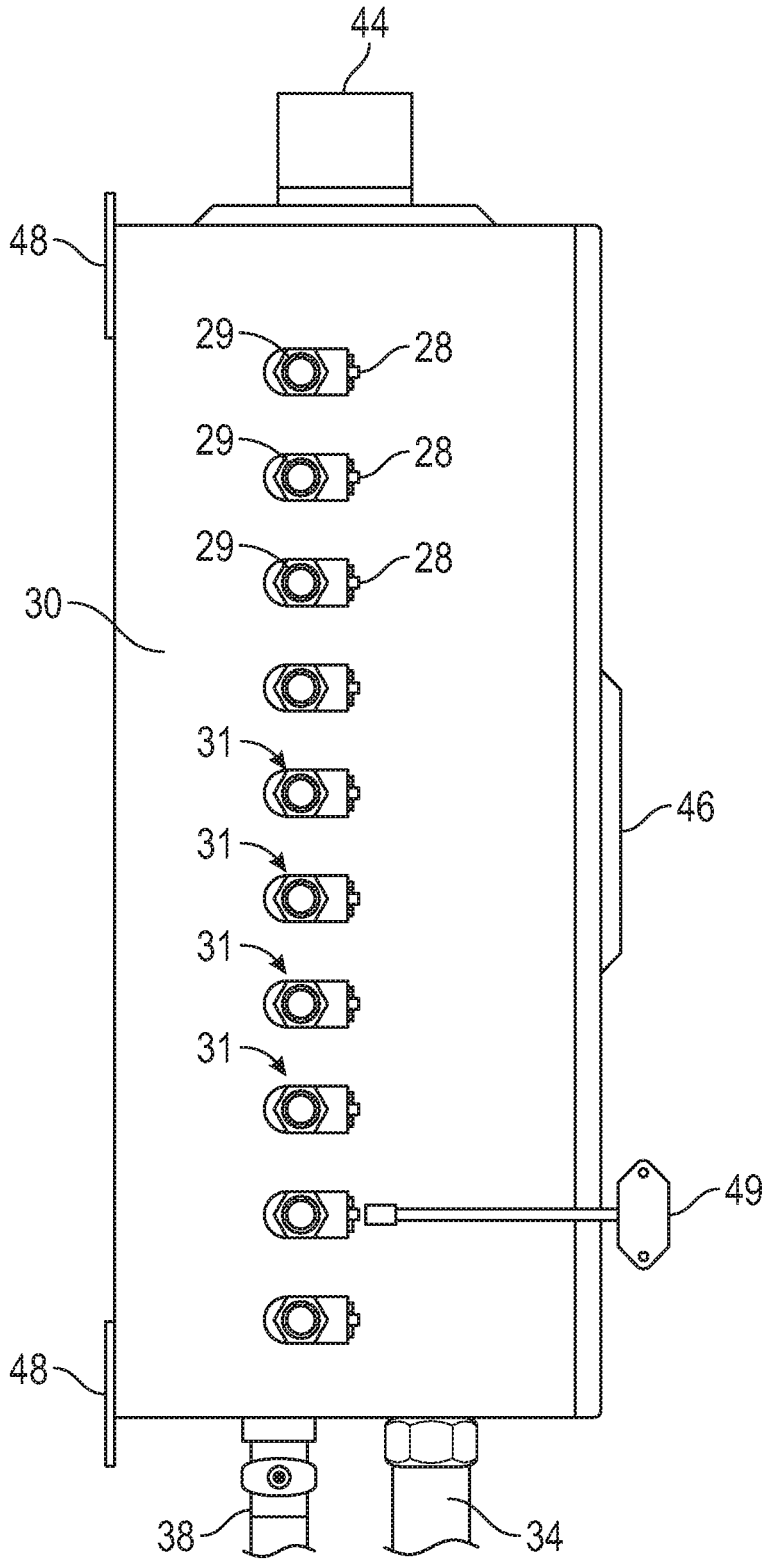
FIG. 3 shows a side elevational view of a tankless water heater system in accordance with the present disclosure.

FIG. 3 shows a side view of the self-contained unit 12 before connecting water distribution lines 20, 32 to the unit during installation of the system 10. In a preferred embodiment, the unit 12 including the tankless water heater 14 and hot water outlet pipe 16 further comprises a valve 28 connected to each outlet port 18 on the hot water outlet pipe 16, as shown in FIGS. 1-3. Individual hot water lines 20, as well as cold water lines 32, may then be connected to each outlet port 18 by connecting each water distribution line 20, 32 to one of the valves 28. Each valve 28 is preferably disposed on an exterior of the case 30 for ease of access, as best seen in FIG. 2. Each valve 28 is preferably a manual two-way valve, such as a standard port or full port ball valve, that may be opened or closed from the exterior of the case 30 using a valve key 49, as shown in FIG. 3. The valves 28 allow each water distribution line 20, 32 to be isolated individually for maintenance on any plumbing fixture 26 or water line without the necessity of shutting off the water supply to the entire system.

Each valve 28 is adapted to removably connect one of the water distribution lines 20, 32 to one of the outlet ports 18, respectively. In a preferred embodiment, as shown in FIG. 3, each valve 28 may comprise a compression nut 29 for connecting a water distribution line 20, 32 to the valve 28. Alternatively, the valves 28, water distribution lines 20, 32, and outlet ports 18 may comprise other suitable fastening structures for connecting these components, such as other types of threaded connections or pipe fittings suitable to a specific application, which may depend on the material of construction of the various components. In a preferred embodiment, as shown in FIG. 2, each valve 28 may have an outlet having a smaller diameter than an inlet for connecting a water distribution line 20, 32 having a smaller diameter than the outlet port 18 to which the valve 28 is connected.

To install and use the present system 10 for supplying hot water to a plurality of plumbing fixtures 26, individual hot water lines 20 (and optional cold water lines 32) may be connected to each respective outlet port 18, either directly or via a valve 28, and to each individual plumbing fixture 26. Thus, each fixture 26 in the system 10 has its own designated hot water line 20 individually connecting the fixture 26 directly to the unit 12. These connections may require water distribution lines 20, 32 of varying lengths depending on the physical proximity of the fixture 26 to the unit 12. A cold water supply is also connected to the cold water inlet 36 of the unit 12 for supplying both hot and cold water to the system 10. In the case of a natural gas heater 14, a gas line may then be connected to the gas inlet 38 on the unit 12. The tankless water heater 14 may then be powered on to supply hot water to all hot water fixtures 26 in the system 10.

Figure 5:
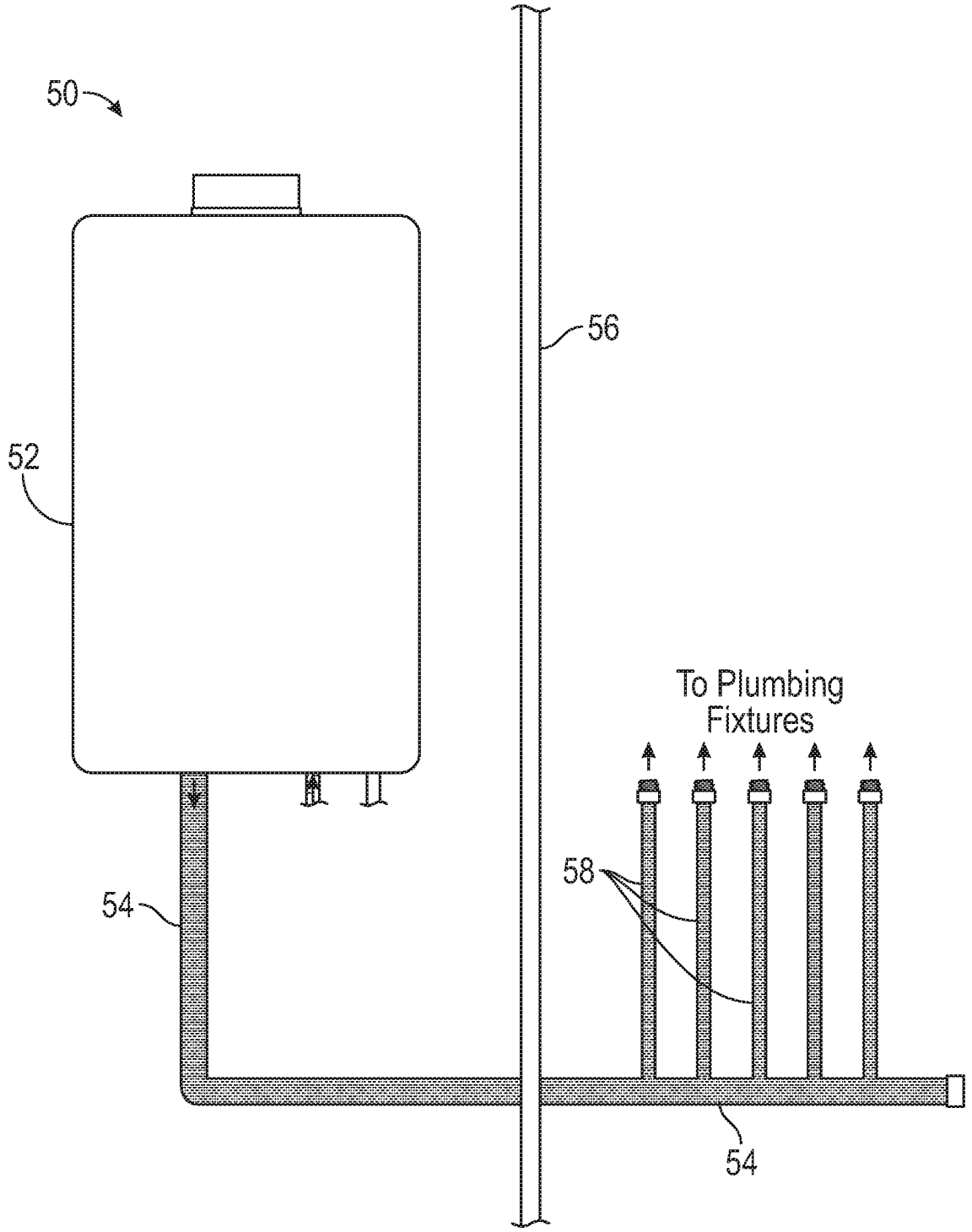
FIG. 5 (Prior Art)
FIG. 5 shows a schematic view of a conventional water heater system in accordance with the present disclosure.

FIG. 5 shows a conventional tankless water heater system 50 that utilizes a tankless heater 52 having only one hot water outlet 54 connected directly to the tankless heater unit 52. The hot water outlet functions as a common header 54 having individual distribution lines 58 branching off from the header 54. The header 54 has a larger diameter than each of the distribution lines 58 to adequately supply hot water when multiple fixtures in the system 50 are being used simultaneously. Often, particularly in residential construction, the heater unit 52 is installed outdoors and the header pipe 54 extends through a wall 56 to an interior space where the distribution lines 58 branch off to individual plumbing fixtures, as shown in FIG. 5. Thus, in order to supply hot water to the fixture supplied by the distribution line 58 farthest from the heater 52, the volume of water in the distribution line 58 as well as in the header 54 between the heater 52 and distribution line 58 must be displaced. Due to the larger volume of the header 54 that is located remote from the heater unit 52, hot water delivery time to the fixture is increased and water is wasted. As discussed above, the present system 10 does not utilize a header that is remote from the self-contained unit 12 for supplying water to each of the water distribution lines 20, 32, which minimizes to the maximum extent possible the amount of water that must be displaced to supply hot water to each plumbing fixture 26. To show the effectiveness of the present system 10, an example system was installed with a natural gas heating unit 12 and tested using a 60-foot length of hot water line 20 with a ½ inch diameter. Hot water was delivered to the fixture 26 within approximately six seconds of opening the fixture, which is significantly faster than is achieved with typical tankless heater 52 installations. Thus, the present system 10 reduces to the maximum extent possible both the wait time for hot water to flow from a fixture 26 once opened and the volume of unheated water wasted.

When installing the present system 10, it is recommended that the unit 12 is installed indoors due to the present system having a plurality of water distribution lines 20, 32, connected to the unit 12, rather than a single hot water outlet 54 connected to a heater unit 52, which may increase the amount exposed piping.

The foregoing description of the embodiments of the present disclosure has been presented for purposes of illustration and description. It is not intended to be exhaustive or to limit the present disclosure to the precise form disclosed, and modifications and variations are possible in light of the above teachings or may be acquired from practice of the present disclosure. The embodiments were chosen and described in order to explain the principles of the present disclosure and its practical application to enable one of skill in the art to utilize the present disclosure in various embodiments and with various modifications as are suited to the particular use contemplated.

What is claimed is:

1. A water heater system comprising:

a case containing a tankless water heater, said case having a source of unheated water at a lower end thereof, said tankless water heater comprising an inlet at a lower end thereof for receiving said unheated water, a portion of said unheated water being diverted to cold water fixtures prior to entering said tankless water heater, a vertically extending hot water outlet ripe outside of said tankless water heater located between an outer wall of said tankless water heater and an outer wall of said case, wherein the hot water outlet pipe has a plurality of outlet ports in said outer wall of said case arranged along a length of the hot water outlet pipe, wherein the hot water outlet pipe is fed with heated water that flows out of a bottom side of said tankless water heater so that there is upward flow of said hot water pipe in said hot water outlet, a plurality of hot water lines each individually connected at one end to a respective one of the plurality of outlet ports on the hot water outlet pipe and at an opposing end to a plumbing fixture, wherein each hot water line is in fluid communication with the hot water outlet pipe, a cold water outlet pipe receiving said diverted unheated water located between said outer wall of said tankless water heater and said outer wall of said case, water within said cold water outlet pipe flowing upwardly, and wherein the cold water outlet pipe has a plurality of outlet ports in said outer wall of said case, said case having a lower outlet fitting for draining water to relieve pressure for maintenance and/or to connect a temporary line for descaling, and whereby said case and said tankless water heater comprise a compact, self-contained unit for distributing hot and cold water to multiple fixtures, and does not include a header that is separate and remote from said self-contained unit for connecting water distribution lines to supply hot water to multiple fixtures.

2. The system of claim 1, wherein said case has a control panel mounted on an outside thereof, said control panel having displays for water temperature, alerts for power failure, and indicator lights as well as controls for adjusting water temperature.

3. The system of claim 2, wherein each of the plurality of hot water lines is connected to a respective one of the plurality of outlet ports via a valve.

4. The system of claim 3, wherein said case is provided with a fresh air intake, an exhaust outlet in a top wall thereof, and a plurality of vent holes on an outside surface of said case wherein each of the valves is disposed on an exterior of the case.

5. The system of claim 4, wherein each valve is adapted to removably connect one of the hot water lines to one of the outlet ports.

6. The system of claim 5, wherein each of the plurality of hot water lines has a diameter smaller than a diameter of the hot water outlet pipe.

7. A method of supplying hot water to a plurality of plumbing fixtures using a tankless water heater system, said method comprising the steps of:

providing a water heater apparatus, wherein the water heater apparatus comprise a tankless water heater inside of an outer case having a vertically extending hot water outlet pipe located outside of said tankless water heater along an inside wall of said outer case for upward flow of heated water inside said hot water outlet pipe, wherein the hot water outlet pipe has a plurality of outlet ports arranged along a length of the hot water outlet pipe in said inside wall of said outer case, said water heater having an inlet at a lower end thereof for receiving unheated water, a portion of said unheated water being diverted to cold water fixtures prior to entering said tankless water heater, providing a cold water outlet pipe for receiving said diverted unheated water located between said outer wall of said tankless water heater and said outer wall of said outer case, water within said cold water outlet pipe flowing upwardly, and wherein the cold water outlet pipe has a plurality of outlet ports in said outer wall of said outer case, providing said outer case with a lower outlet fitting for draining water to relieve pressure for maintenance and/or to connect a temporary line for descaling, mounting the self-contained unit onto a fixed structure, connecting one end of a hot water line to each one of the plurality of outlet ports, respectively, connecting an opposite end of each respective hot water line to an individual plumbing fixture, and supplying water to the tankless water heater through a bottom wall thereof.

8. The method of claim 7, providing said outer case with a control panel mounted on an outside thereof, said control panel having displays for water temperature, alerts for power failure, and indicator lights as well as controls for adjusting water temperature.

9. The method of claim 8, wherein the step of connecting one end of a hot water line to each one of the plurality of outlet ports comprises connecting each hot water line to an individual valve and connecting each valve to one of the outlet ports.

10. The method of claim 9, providing said outer case with a fresh air intake and an exhaust outlet in a top wall thereof, and a plurality of vent holes on an outside surface of said outer case.

11. The method of claim 10, wherein each valve is adapted to removably connect one of the hot water lines to one of the outlet ports.

12. The method of claim 7, wherein each of the plurality of hot water lines has a diameter smaller than a diameter of the hot water outlet pipe.

* * * * *